United States Patent [19]

Bardin et al.

[11] 4,335,804

[45] Jun. 22, 1982

[54] VORTEX-TYPE OIL MIST GENERATOR

[76] Inventors: Viktor P. Bardin, ulitsa Oktyabrskaya, 17/3, kv. 43, Kolpino Leningradskoi oblasti; Evgeny A. Petrov, ulitsa Bela Kuna, 27, korpus 1, kv. 53, Leningrad; Viktor M. Rudelson, pereulok Makarenko, 3, kv. 32, Leningrad; Jury L. Sternik, Zanevsky prospekt, 43, kv. 170, Leningrad, all of U.S.S.R.

[21] Appl. No.: 62,040

[22] Filed: Jul. 30, 1979

[51] Int. Cl.[3] ..... B05B 7/10

[52] U.S. Cl. ..... 184/55 A; 239/338; 239/371; 239/406; 261/78 A

[58] Field of Search ..... 239/338, 340, 341, 346, 239/369–371, 403–406; 184/6.26, 55 R, 55 A; 261/78 A; 252/359 A

[56] References Cited

U.S. PATENT DOCUMENTS 2,050,368 8/1936 Neely ..... 239/406

3,515,676 6/1970 Hierta et al. ..... 252/359 A 3,605,942 9/1971 Lyth ..... 184/55 A 4,201,276 5/1980 Bardin et al. ..... 184/55 A

*Primary Examiner*—Robert W. Saifer

*Attorney, Agent, or Firm*—Robert E. Burns; Emmanuel J. Lobato; Bruce L. Adams

[57] ABSTRACT

An oil mist generator of the vortex type comprises an oil storage chamber, a vortex chamber adapted to create a rotating flow of gas, and a duct having an inlet being in communication with the oil storage chamber and an outlet delivering the oil into the rotating flow of gas. The vortex chamber is provided with tangentially arranged inlet openings delivering a pressurized gas thereinto and an axial outlet opening, the ratio of the total area of the tangentially arranged inlet openings to the area of the axial outlet opening not exceeding 0.7, thus providing a suction area within the vortex chamber. The duct outlet is disposed within the vortex chamber suction area.

7 Claims, 10 Drawing Figures

VORTEX-TYPE OIL MIST GENERATOR

FIELD OF THE INVENTION

The present invention relates to apparatus for generating a lubricant particle suspension in a gaseous carrier and, more particularly, to oil mist generators.

The invention can most advantageously be used in association with metallurgy and machinery for the purpose of lubricating machinery parts such as bearing units, gear or link transmissions when there is a large distance between the mist generator and the machinery part to be lubricated and when required to atomize liquid lubricant into finely divided particles.

BACKGROUND OF THE INVENTION

The present oil mist generators operating on a vortex principle enjoy a best combination of properties as compared to other known types of the oil mist generators, namely, as compared to the generators provided with a throat of a venturi. This results from the fact that the vortex type generator enables the rotating flow of gas to be moved with a higher rate and permits an increase in the magnitude of the differential in pressure across the suction duct supplying the oil into the flow of gas.

Known in the prior art is an oil mist generator which operates on a vortex principle (cf. USSR Inventor's Certificate No. 448,891, Int. Cl. B 05 B 7/10). The generator includes an oil storage chamber, a cover having an oil mist outlet, a vortex chamber for creating a rotating flow of gas and having tangentially disposed inlets for a pressurized gas and a long cylindrical outlet axially arranged and connecting the vortex chamber with an intermediate chamber which, in turn, is in communication with the oil storage chamber. As the pressurized gas is directed through the tangentially arranged inlets into the vortex chamber, the flow of gas develops significant axial and tangential velocities, with the result that a suction area is created on the outer periphery of the vortex chamber outlet, which area is in communication with the intermediate chamber through passageways.

It should be noted that the long cylindrical outlet tends to slow down the flow of gas, thus reducing both flow rate and quality of oil atomization.

Furthermore, in the known oil mist generator, the oil is delivered into the intermediate chamber and directed therein towards the outlet of the vortex chamber through the corresponding passageways which fail to provide a significant interaction surface between the oil and the flow of gas as it moves therepast.

The disadvantages mentioned hereinabove are eliminated in a known vortex type generator (cf. U.S. Pat. No. 3,515,676, U.S. Cl. 252-359), which comprises a vortex chamber adapted for creating a rotating flow of gas and provided with tangentially disposed inlets and an axially disposed outlet, and an interaction chamber having tangentially arranged passageways supplying the oil into the rotating flow of gas moving out of the vortex chamber outlet. As the pressurized air is forced through the tangentially arranged inlets into the interior of the vortex chamber the flow of gas develops significant axial and tangential velocities. The rotating flow of gas, as it leaves the outlet of the vortex chamber, creates a suction area in the interaction chamber, which suction causes the liquid to be aspirated thereinto. The liquid is directed from the interaction chamber into the flow of gas in the direction of the tangential gas velocity, thus increasing the degree of liquid atomization which also increases with increase in ratio between the contact area of the gas flow and the volume of liquid to be atomized.

The generator is further provided with a lubricant flow regulator valve used for adjustably controlling the quantity of liquid to be atomized.

However, such a mist generator of the vortex design fails to provide a sufficient suction at the outlet of the vortex chamber for the atomization of high viscosity oil. This causes the oil to be preheated to a relatively high temperature, thus resulting in an excessive expenditure of energy.

Furthermore, a low suction in the interaction chamber of the known generator is inadequate to provide a wide adjustment range of the suction and, hence, of the amount of oil to be aspirated into the rotating flow of gas.

Also known in the art is an oil mist generator (cf. U.S. Pat. No. 3,605,942, U.S. Cl. 184-6.26) which in, addition to the members mentioned hereinabove, is further provided with a screen aligned with the vortex chamber and adjustable toward and away from the vortex outlet, and with an auxiliary oil channel arranged externally of the vortex chamber and aligned therewith, said channel being mounted for movement toward and away from the vortex outlet. In operation, said oil mist generator, when used in combination with the screen adjustable toward and away from the vortex outlet, permits the suction and the amount of oil aspirated into the rotating flow of gas, as well as the size and quantity of particles in the oil mist to be somewhat widely controlled. Said oil channel provides the useful suction area to be created in the axial zone of the rotating flow of gas moving outside the vortex chamber as well as on the outer periphery of the vortex chamber outlet. The supplying of oil through said oil channel makes possible to provide a high density mist. Moreover, such a generator enables the ratio between the contact area of gas flow and the volume of oil to be atomized to be increased with simultaneous increase in mist dispersity.

The auxiliary oil channel being arranged outside the vortex chamber, the axial velocity of the rotating flow of gas is oppositely directed with respect to the oil flowing in the auxiliary channel, thus resulting in deceleration of oil flow at the outlet of said channel.

Furthermore, the oil exiting from the outlet of the auxiliary channel fails to be directed in the zone of the rotating flow of gas of maximum tangential velocity, besides the time of gas and oil interaction is insufficient to effect thorough atomization.

In addition, such an oil mist generator for changing the oil mist density, the amount of liquid to be atomized and the particle size utilizes a relatively large number of elements incorporated therein, which complicates its adjustment and control.

SUMMARY OF THE INVENTION

It is an object of the present invention to provide an oil mist generator improving an aspiration of the oil into the rotating flow of gas.

Another object of the present invention is to provide an oil mist generator producing a high density mist.

A further object of the invention is to provide an oil mist generator producing a mist having a high degree of dispersity.

Yet another object of the present invention is to provide an oil mist generator permitting to control a mist density.

Still another object of the present invention is to provide an oil mist generator permitting to control a degree of oil mist dispersity.

A more specific object of the present invention is to provide an oil mist generator eliminating a choking of oil supply passageways.

A further object of the present invention is to provide an oil mist generator permitting a higher viscosity oil to be used for generating a mist as compared with the known one.

Yet another object of the present invention is to provide an oil mist generator permitting a lower temperature oil to be used for generating a mist as compared with the known one.

Still another object of the present invention is to provide an oil mist generator generating such an oil mist which is suitable to be transported for a large distance.

Yet another object of the present invention is to provide an oil mist generator generating an oil mist which is suitable to be transported to the machinery parts to be lubricated, with a minimum expenditure of energy and compressed gas.

With these and other objects in view, there is proposed a vortex type oil mist generator comprising an oil storage chamber, a vortex chamber adapted for creating a rotating flow of gas and having tangentially arranged inlet openings for a pressurized gas and an axial outlet opening, a duct having its inlet portion open to the oil storage chamber and its outlet portion adapted for supplying the oil into the rotating flow of gas, wherein, according to the invention, the ratio of the total area of the tangentially arranged inlet openings of the vortex changer to that of the vortex chamber outlet opening does not exceed 0.7, thus providing a suction area within the vortex chamber, the outlet portion of the duct being located in the suction area created within said vortex changer.

The advantage of the proposed generator resides in that the given ratio of the total area of the tangentially arranged inlet openings of the vortex chamber to that of the vortex chamber outlet opening provides for a suction area created within the vortex chamber, the pressure in said suction area being 0.2 to 0.8 kgf/cm$^2$ lower than in the oil storage chamber. This causes an excessive amount of oil to be aspirated into the rotating flow of gas, permits the oil mist to be generated from the oil of lower temperature and/or of high degree of viscosity, and provides an efficient atomization of the oil.

Moreover, the proposed oil mist generator enables the surface of contact between the oil and the mass of gas to be increased as well as the length of their interaction period. As a result, the proposed generator as compared to the prior art mist generators provides an increase in the degree of atomization of the oil and permits the generated oil mist to be utilized for effecting lubrication of machinery parts far removed from the generator.

Another advantage of the proposed generator is the generation of high density mist and the transportation of the mist to the machinery parts to be lubricated with less expenditure of energy and pressurized gas. This is achieved due to an increased suction created in the zone where the oil is aspirated into the rotating flow of gas, as well as due to a more efficient atomization of the oil contained in the flow of gas.

It is advisable that the ratio of the total area of the tangentially arranged inlet openings for a pressurized gas to the area of the axial outlet opening should be in the range from 0.3 to 0.5.

The given range is optimal to provide the maximum difference in pressure between the oil storage chamber and the suction area.

It is further advisable that the outlet portion of the duct be arranged within the vortex chamber and be adjustable toward and away from the axial outlet opening of the vortex chamber to control the suction.

Such an arrangement of the duct outlet portion permits the suction and the amount of oil, being atomized, to be controlled without using a valve member which possesses a low reliability because of its choking.

It is further advisable than the outlet portion of the duct be provided with a core disposed therein and having passageways delivering the oil into the peripheral zone of the suction area and being in communication with the interior of said duct.

The outlet portion of the duct provided with the core, the oil can be supplied into the zone of maximum velocities, of the rotating flow of gas, this increasing the degree of oil mist dispersity.

In one embodiment, the core has passageways disposed eccentrically to the core axis.

The eccentric arrangement of the core passageways provides an improved aspiration of the oil into the rotating flow of gas, decreases the losses in the gas flow energy expended in the oil aspiration, and results in a more efficient atomization of the oil.

In another embodiment, the core is provided with passageways adapted for discharging the oil into the peripheral zone of the suction area and designed as spiral grooves, the axial direction of the spiral generatrices of said grooves coinciding with that of the rotating flow of gas.

Owing to the provision of the passageways spirally grooved in the core, the possibility exists of providing the passageways which have a large length and offer a significant resistance to the flow of oil, thus preventing an aspiration of an excessive amount of oil into the rotating flow of gas without a decrease in the passageway area, which decrease can result in the choking of the passageways with solid particles contained in the contaminated oil.

In addition, the spiral grooves cut in the core to form the passageways permit the oil to be aspirated into the rotating flow of gas most efficiently, thus decreasing both losses in energy required for an aspiration of the oil and the particle size of the oil to be atomized.

It is expedient that the core be rotatably mounted with respect to the outlet portion of the oil delivery duct and be provided with an impeller rigidly secured thereto. In this case, it is essential that the passageways adapted to deliver the oil into the peripheral zone of the suction area be designed as spiral grooves, the axial direction of the generatricies of said grooves being opposite to that of the rotating flow of gas. In this case, the rotating flow of gas acting upon the impeller blades causes the core to be rotated in a direction coinciding with the direction of gas flow rotation.

The axial direction of the generatricies of the spiral grooves being opposite to that of the rotating flow of gas, an excessive amount of suction is created by the reactive forces, thus increasing the pressure difference which causes the oil to be aspirated from the oil storage chamber into the rotating flow of gas. Moreover, the reactive forces arised therewith facilitate removal of the solid particles from the grooves, thus preventing the groove choking.

Another advantage of such an embodiment of the core and of its connection with the impeller resides in that the rotating flow of gas causes the impeller to be rotated, which, in turn, gives rise to an extra mechanical action upon the oil and the oil particles are additionally sheared by the impeller blades, resulting in an increased dispersity of the oil mist.

BRIEF DESCRIPTION OF THE DRAWINGS

Further objects, advantages, and features of the present invention will be apparent to those skilled in the art to which it relates from the following detailed description of a preferred embodiment of the present invention made with reference to the accompanying drawings in which.

DETAILED DESCRIPTION OF THE INVENTION

Figure 1:
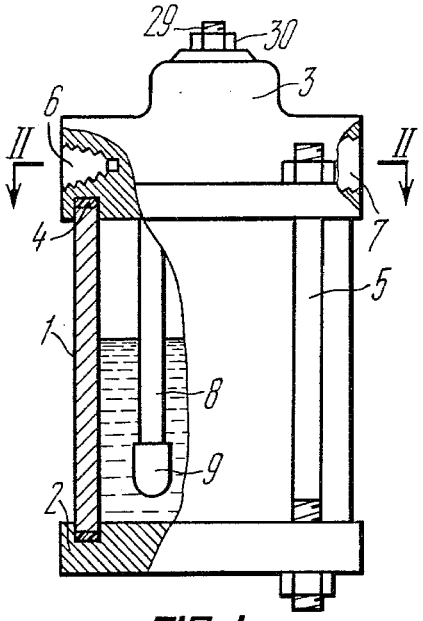
FIG. 1 is a fragmentary sectional view of an oil mist generator embodying the present invention.
Figure 2:
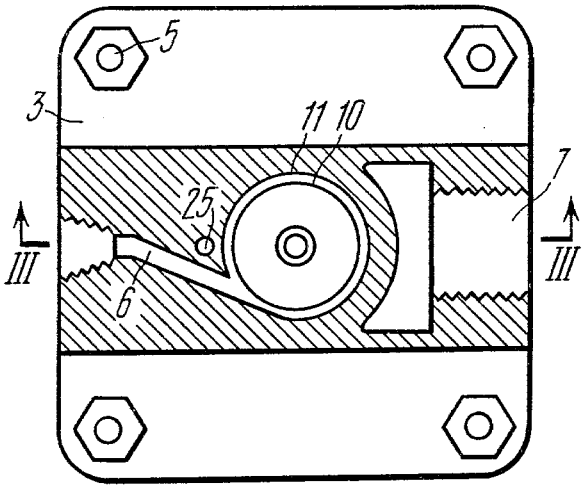
FIG. 2 is an enlarged cross-sectional view taken along line II—II of FIG. 1.

Referring now to the accompanying drawings, and initially to FIG. 1, the vortex type oil mist generator embodying the present invention comprises an oil storage chamber 1, a bottom 2 and a head member 3, all being secured in a sealing relationship by means of sealing members 4 arranged therebetween and fasteners 5. The head member 3 has a pressurized gas inlet 6 (FIG. 2) adapted to deliver a pressurized air or any other gas used for atomizing the oil, and an oil mist outlet 7 discharging the oil mist to points requiring lubrication.

Also shown in FIG. 1 is a tube 8 having its inlet portion provided with a filter 9 and introduced into the oil. The tube 8 is secured to the head member 3.

The inlet 6 (FIG. 2) is adapted to be in communication with an annular cavity 10 defined by a cylindrical bore 11 formed in the head member 3 and by a nozzle 12 (FIG. 3) and a cover 13 axially arranged in said bore. The nozzle 12 has a flange portion 14 which rests on a sealing member 15 and is pressed against an annular projection 16 of the head member 3 by means of a thread plug 17 which brings the cover 13 into contact with the end surface of the nozzle 12 so that the pressurized gas is delivered from the annular cavity 10 into a vortex chamber 18 adapted to create a rotating flow of gas only through tangentially arranged inlet openings 19 and is discharged therefrom only through an axial opening 20. The cover 13 and the thread plug 17 are provided with sealing members 21 and 22 used to separate the annular cavity 10 from an oil delivery passageway 23 communicating with the tube 8 through passageways 24 and 25.

The passageway 24 accomodates an intake plug 26 arranged within the outlet opening thereof. When setting the generator, a suitable manometer (not shown) can be provided in association with the outlet opening of the passageway 24. Extending through the axial openings of the thread plug 17 and the cover 13 is a slide 27 mounted for movement in an axial direction and provided with sealing members 28 and 29 preventing the oil leakage through the mating surfaces. The upper end of the slide 27 has a thread portion 30 screwed into a corresponding threaded bore formed within the plug 17. A nut 31 is used to adjustably lock the slide 27 in a position corresponding to a required suction. The slide 27 had a passageway 32 formed therein and communicating with the passageway 23. The tube 8 taken in combination with the passageways 25, 24, 23 and 32 provides an oil delivery duct its inlet portion being defined by the tube 8 and its outlet portion 33 extending into the suction area of the vortex chamber 18.

Figure 3:
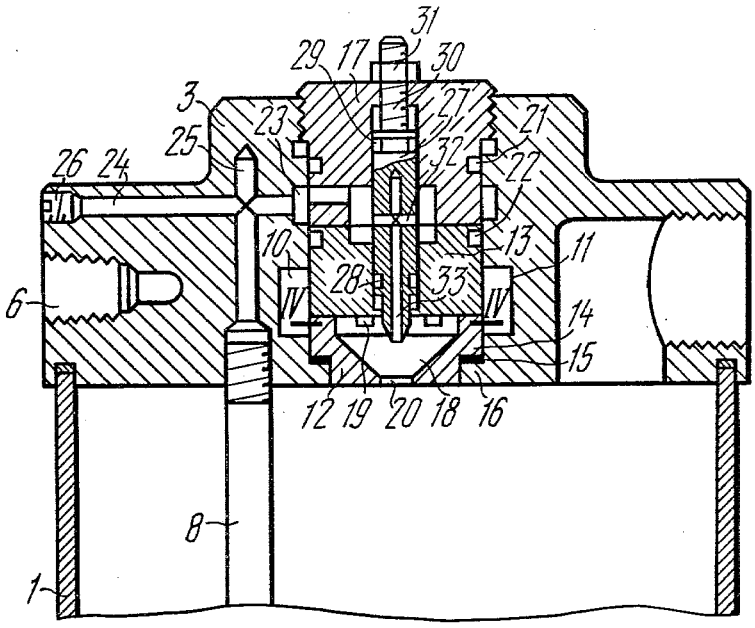
FIG. 3 is a cross-sectional view of the upper part of the generator, taken along line III—III of FIG. 2.
Figure 4:
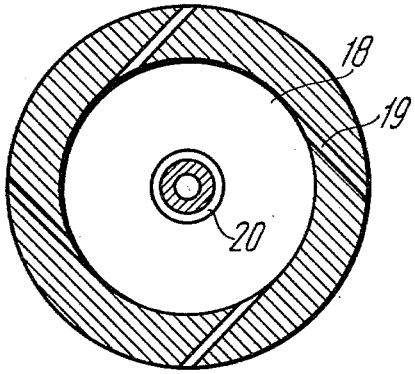
FIG. 4 is an enlarged cross-sectional view of a vortex chamber, taken along line IV—IV of FIG. 3.

As best shown in FIG. 4, the vortex chamber 18 has the openings 19 and the opening 20. To create a rotating flow of gas, the openings 19 are tangentially arranged and are extending in the same direction with respect to the axis of the vortex chamber 18 (FIGS. 3 and 4). As it will be described hereinbelow in greater detail, in order to provide the suction area within the vortex chamber 18, the ratio between the total area of the openings 19 and the area of the opening 20 should not exceed 0.7, and preferably be in the range from 0.3 to 0.5.

Figure 5:
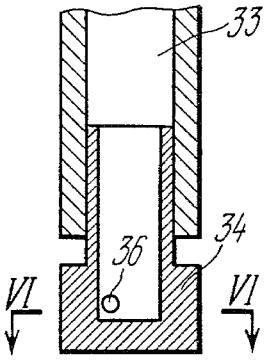
FIG. 5 is an enlarged view of a core for delivering the oil into the peripheral zone of the suction area created in the vortex chamber.
Figure 6:
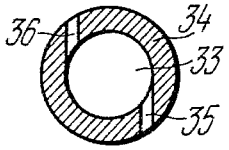
FIG. 6 is a sectional view taken along line VI—VI of FIG. 5.

FIGS. 5 and 6 illustrate an enlarged view showing an outlet portion 33 of the oil delivery duct. Said portion accomodates a core 34 tightly arranged therein and having eccentrically disposed passageways 35 and 36 delivering the oil into the peripheral zone of the suction area.

Figure 7:
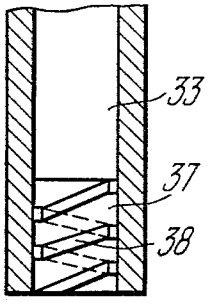
FIG. 7 is a view of another embodiment of the core.

FIG. 7 also shows an enlarged view of the outlet portion 33 of the oil delivery duct, which accomodates a core 37 tightly arranged therein and having passageways shaped like spiral grooves 38. The axial direction of the generatrices of said grooves coincides with the direction in which the gas is rotating, as defined by the tangentially arranged openings 19 (FIG. 4).

Figure 8:
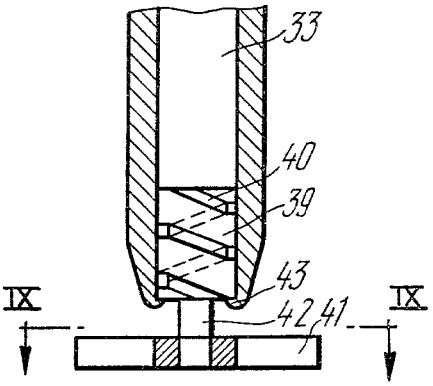
FIG. 8 is a view of still another embodiment of the core.
Figure 9:
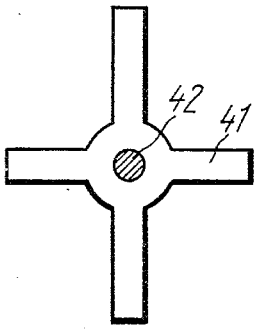
FIG. 9 is a sectional view taken along line IX—IX of FIG. 8.

FIG. 8 is an enlarged view of the outlet portion 33 with a core 39 mounted therein and having the passageways shaped like spiral grooves 40, the axial direction of the generatrices of said grooves being opposite to the direction in which the gas is rotating. An impeller 41 is rigidly secured to a pin 42 (FIG. 9) of the core 39 (FIG. 8).

The lower end of the slide 27 (FIG. 3) is partly beaded, thus forming projections 43 (FIG. 8) used to restrict an axial displacement of the core 39 (FIG. 8) in a downward direction.

In operation, the pressurized gas is forced through the inlet opening (FIG. 3) into the annular cavity 10 and then is directed into the tangentially arranged inlet openings 19 of the vortex chamber 18. As a result, the gas, as it leaves the inlet openings 19, is swirled and expands radially and axially towards the outlet opening 20 of the vortex chamber 18, the tangential velocities being increased with decreasing radius of gas swirl.

The rotating mass of gas flowing in the vortex chamber 18 creates a suction area as well as the difference in pressure between the inlet of the tube 8 introduced into the oil and the outlet portion 33 of the oil delivery duct extending into the suction area. The difference in pressure causes the oil to be aspirated from the oil storage chamber 1 into the rotating flow of gas where the oil is atomized, thus generating the oil mist which is then delivered through the opening 7 (FIG. 1) to points (not shown) requiring lubrication. The oil supplied directly into the vortex chamber 18 tends to increase the atomizing effect due to an increase in the surface of contact between the oil and the mass of gas as well as due to an increase in the length of interaction period.

As found experimentally, when the ratio of the total area $F_1$ of the tangentially arranged inlet openings 19 to the area $F_2$ of the axial outlet opening 20 of the vortex chamber 18 is in the certain range a stable suction area is created within the vortex chamber 18, the suction varying along the axis of the vortex chamber 18.

Figure 10:
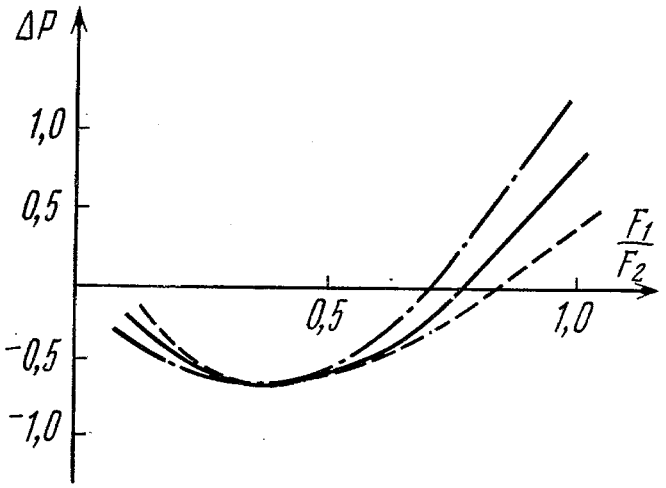
FIG. 10 represents curves showing suction pressure $\Delta P$ created within the vortex chamber as a function of ratio of the total area $F_1$ of the tangentially arranged inlet openings of the vortex chamber to the area $F_2$ of the axial outlet opening.

Is is also found that the maximum suction is only slightly determined by the geometrical characteristics of the chamber 18, but is substantially governed by the ratio of $F_1$ to $F_2$. FIG. 10 represents the curves showing the maximum suction pressure $\Delta P$ created within the vortex chamber 18 as a function of the ratio of $F_1$ to $F_2$ for three different values of the differential in pressure $\Delta P_1$ between the tangentially arranged inlet openings 19 for a pressurized gas and the interior of the oil storage chamber 1, said values being equal to 2, 3 and 4 $kgf/cm^2$, respectively, thus covering the whole range of the differentials in pressure $\Delta P_1$ used in practice.

As indicated in FIG. 10, when the ratio of $F_1$ to $F_2$ does not exceed 0.7, the oil is caused to be aspirated into the vortex chamber 18, and the suction pressure reaches its maximum when said ratio is in the range between 0.3 and 0.5, said range being optimal to provide a high density oil mist.

It is well known that the distribution of tangential velocities of the gas flow over the radius of gas vortex is nonuniform and has a maximum. From the theory of liquid particle atomization it is known, that the liquid is most finely divided when it is supplied into the zone of highest velocities of the rotating gas flow. It has been experimentally found that the suction area created within the vortex chamber 18 is shaped like a paraboloid of revolution, the rotating flow of gas reaching the maximum tangential velocities on the outer periphery thereof. As a result, the generated oil mist possesses a high degree of dispersity when the oil is caused to be aspirated into the peripheral zone of the suction area by the use of the core 34 (FIGS. 5 and 6) having the passageways 35 and 36 being in communication with the outlet portion 33 of the oil delivery duct. In one of the generators embodied according to the present invention, the core diameter was equal to 0.3 time the radius of the vortex chamber 18. The eccentrically arranged passageways 35, 36 direct the oil tangentially with respect to the direction in which the flow of gas is rotating, which tends to increase the effect of aspiration of the oil into the rotating flow of gas and to decrease the size of light particles while being atomized.

The similar effect is achieved by using the core 37 (FIG. 7) provided with the spiral grooves 38. Spiral arrangement of the passageways grooved in the core 37 enables the length of said passageways to be considerably increased over the same length of the core, thus offering a significant resistance to the oil flow and preventing an excessive amount of oil to be supplied into the rotating flow of gas without an undue decrease in the cross-sectional area of said passageways, which decrease can lead to the passageway choking with solid particles contained in the contaminated oil.

The core 39 (FIG. 8) having the spiral grooves 40 is rotatably mounted within the outlet portion 33 of the duct. When the rotating flow of gas impacts against the blades of the impeller 41 which is rigidly secured to the core 39, the latter is caused to rotate at a high rate in a direction generally coinciding with the direction of gas rotation.

The axial direction of the generatrices of the spiral grooves 40 of the core 39 being opposite to the axial direction of the gas flow, the reactive forces arising from the core rotation contribute to an excessive amount of suction and to an increased differential in pressure, thus causing the oil to be aspirated from the oil storage chamber 1 (FIG. 3) into the rotating flow of gas.

Among other things, said reactive forces aid in drawing off solid particles, contained in the contaminated oil, from the grooves 40 (FIG. 8), thus preventing the groove choking. Since the impeller 41 is caused to rotate by the rotating flow of gas, it mechanically acts on the oil particles which are additionally sheared by the impeller blades with the result that the oil mist is further atomized to a higher degree of dispersity.

Although the present invention is herein disclosed with reference to the oil used as a liquid to be atomized, it will be apparent to those skilled in the art that any other liquid may be atomized without departure from the essence of the invention.

What is claimed is:

1. A vortex-type oil mist generator comprising an oil storage chamber, a vortex chamber adapted to create a rotating flow of gas and having tangentially arranged inlet openings for admitting a pressurized gas and an axial outlet opening, the ratio of the total area of said tangentially arranged inlet openings to the area of said axial outlet opening not exceeding 0.7, thus providing a suction area within said vortex chamber, and means defining an oil delivery duct having an inlet portion in communication with said oil storage chamber and an outlet portion extending into said suction area.

2. A generator as defined in claim 1, wherein the ratio of the total area of said tangentially arranged inlet openings to the area of said axial outlet opening is in the range from 0.3 to 0.5.

3. A generator as defined in claim 1, wherein said outlet portion of said oil delivery duct is arranged within said vortex chamber and is adjustable toward and away from said axial outlet opening to reduce and to increase, respectively, the suction.

4. A generator as defined in claim 1, wherein said duct accommodates a core arranged within said outlet portion thereof and having passageways to deliver the oil into the peripheral zone of the suction area and being in communication with said duct.

5. A generator as defined in claim 4, wherein said passageways of said core are disposed eccentrically to the axis of said core.

6. A generator as defined in claim 4, wherein said passageways of said core are spiral grooves, the axial direction of the generatrices of said grooves coinciding with the axial direction of the rotating flow of gas.

7. A generator as defined in claim 4, wherein said core is rotatable with respect to said outlet portion of said duct and is provided with an impeller arranged coaxially with said core and rigidly secured thereto, and said passageways are spiral grooves, the axial direction of the generatrices of said grooves being opposite to the axial direction of the rotating flow of gas.

* * * * *